US009187992B2

(12) United States Patent
Cherian et al.

(10) Patent No.: US 9,187,992 B2
(45) Date of Patent: Nov. 17, 2015

(54) INTERACTING HYDRAULIC FRACTURING

(71) Applicant: Schlumberger Technology Corporation, Sugar Land, TX (US)

(72) Inventors: Bilu Verghis Cherian, Lone Tree, CO (US); Maraden Panjaitan, Highlands Ranch, CO (US); Jayanth Krishnamurthy, Denver, CO (US)

(73) Assignee: Schlumberger Technology Corporation, Sugar Land, TX (US)

( * ) Notice: Subject to any disclaimer, the term of this patent is extended or adjusted under 35 U.S.C. 154(b) by 83 days.

(21) Appl. No.: 13/869,482

(22) Filed: Apr. 24, 2013

(65) Prior Publication Data

US 2013/0277050 A1 Oct. 24, 2013

Related U.S. Application Data

(60) Provisional application No. 61/637,585, filed on Apr. 24, 2012.

(51) Int. Cl.
*E21B 43/267* (2006.01)
*E21B 43/17* (2006.01)

(52) U.S. Cl.
CPC ..... *E21B 43/17* (2013.01); *E21B 43/267* (2013.01)

(58) Field of Classification Search
CPC ..... E21B 43/26; E21B 43/267
See application file for complete search history.

(56) References Cited

U.S. PATENT DOCUMENTS

| | | | | |
|---|---|---|---|---|
| 6,776,235 | B1 | 8/2004 | England | |
| 7,069,990 | B1 * | 7/2006 | Bilak | 166/271 |
| 7,581,590 | B2 | 9/2009 | Lesko et al. | |
| 2013/0032336 | A1 * | 2/2013 | Abbate et al. | 166/250.01 |

* cited by examiner

*Primary Examiner* — William P Neuder
(74) *Attorney, Agent, or Firm* — Rachel E. Greene; Tim Currington

(57) ABSTRACT

A fracture extending away from a first subterranean well and toward a second subterranean well may be initiated by pumping fluid into the first subterranean well. The fracture may be propagated further towards the second subterranean well by continuing to pump fluid into the first subterranean well, while monitoring a pressure in the second subterranean well. Proppant may be pumped into the second subterranean well via the first subterranean well and the fracture upon detection of a change in the monitored pressure in the second subterranean well. The change in monitored pressure in the second subterranean well may be sufficient to indicate that the first and second wells are in fluid communication and interacting via the fracture.

10 Claims, 6 Drawing Sheets

INTERACTING HYDRAULIC FRACTURING

CROSS-REFERENCE TO RELATED APPLICATIONS

This application claims the benefit of U.S. Provisional Application No. 61/637,585, entitled "INTERACTING HYDRAULIC FRACTURING METHOD," filed Apr. 24, 2012, the entire disclosure of which is hereby incorporated herein by reference.

BACKGROUND OF THE DISCLOSURE

Hydrocarbon fluids such as oil and natural gas are obtained from a subterranean geologic formation by drilling a well that penetrates the hydrocarbon-bearing formation. This provides a partial flowpath for the hydrocarbon to reach the surface. The hydrocarbon is "produced," or travels from the formation to the wellbore (and ultimately to the surface), via a sufficiently unimpeded flowpath from the formation to the wellbore.

Hydraulic fracturing is a tool for improving well productivity by placing or extending channels from the wellbore to the formation. This operation comprises hydraulically injecting a fracturing fluid into a wellbore penetrating a subterranean formation, thus forcing the fracturing fluid against the formation strata by pressure. The formation strata or rock is thus forced to crack and fracture. Proppant may then be placed in the fracture to prevent the fracture from closing.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
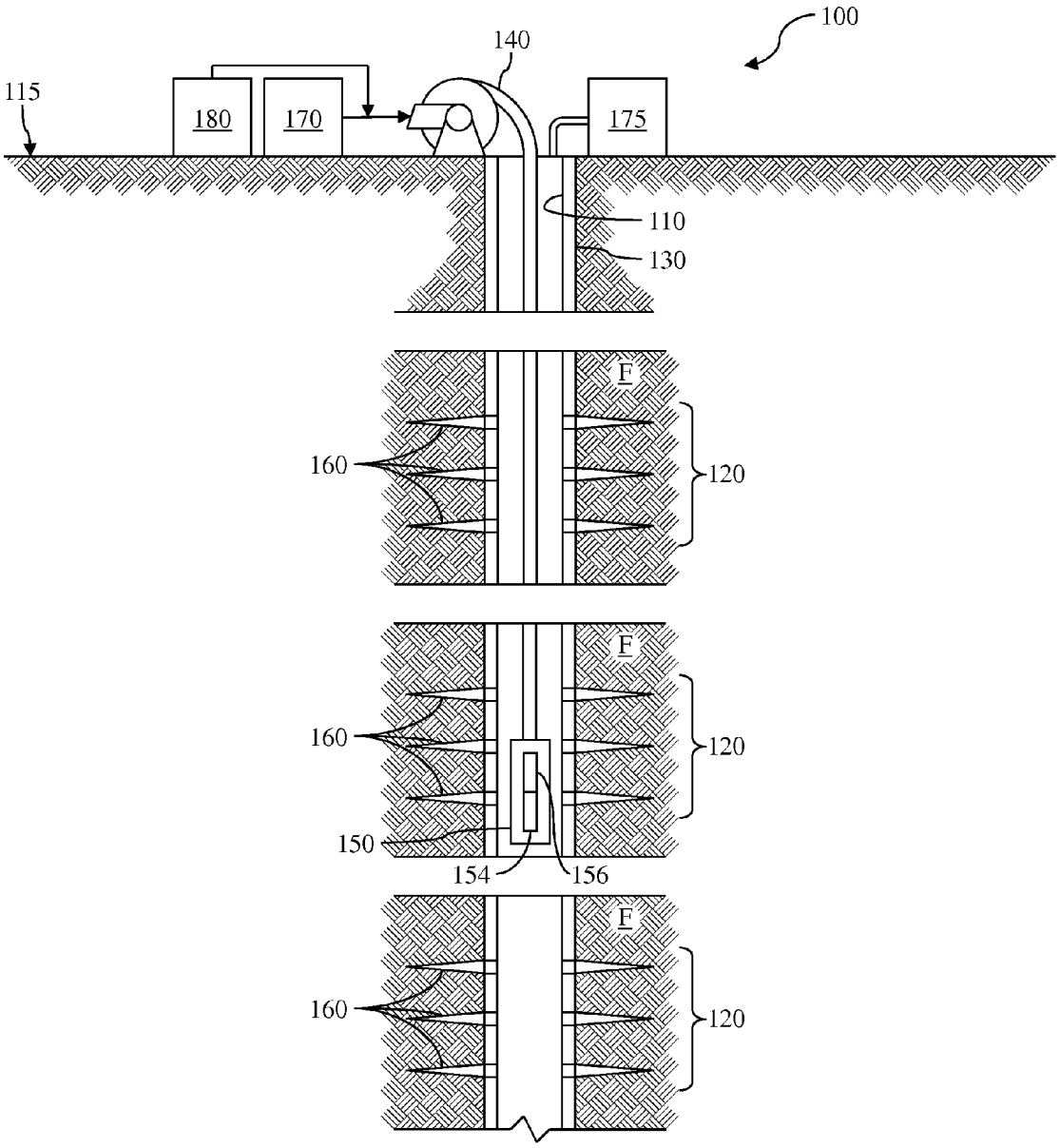
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, one or more inventive and/or other aspects of the present disclosure may lie in less than all features of a single disclosed implementation and/or embodiment. Thus, the claims following the Detailed Description are hereby expressly incorporated into this Detailed Description, with each claim standing on its own as a separate implementation and/or embodiment of this disclosure.

FIG. 1 is a schematic view of at least a portion of a wellsite 100 according to one or more aspects of the present disclosure. For example, at least a portion of the wellsite 100 is operable to perform the treatment of multiple zones of interest using one or more aspects of interacting hydraulic fracturing within the scope of the present disclosure.

The wellsite 100 comprises a wellbore 110 that intersects one or more subterranean formations and establishes multiple zones of interest 120. At least a portion of the wellbore 110 may be cased and thus comprise a casing string 130, although one or more aspects of the present disclosure may be similarly applicable and/or readily adaptable for use with uncased or "open" wellbores. The casing string 130 may be cemented in the wellbore 110, such as by pumping cement into the annulus between the casing string 130 and the sidewalls of the wellbore 110. However, the casing string 130 may not be cemented, such as where the casing string 130 lines a lateral or other section of the wellbore 110. Thus, it is appreciated that the casing string 130 may be a liner, broadly considered herein as any form of casing, including that which may not extend to the surface 115, such as a specific interval length along a vertical, horizontal, and/or deviated wellbore.

A conveyance string 140 comprising and/or otherwise coupled to a bottom-hole assembly (BHA) 150 may extend downhole from the surface 115 of the wellsite 100 into the wellbore 110. The conveyance string 140 may be or comprise coiled tubing. However, one or more aspects of the present disclosure may be similarly applicable and/or readily adaptable for use with another type of string, such as a drillstring and/or other jointed tubing string, wired drill pipe, wireline, slickline, and/or others.

The wellsite 100 is depicted in FIG. 1 as being in a state in which fluid connectivity between the wellbore 110 and the zones 120 has been established, as depicted by perforations 160 that penetrate the casing string 130 and extend into the surrounding formation(s) F. Perforation of the zones 120 may be performed by jetting subs, for example, as well as other conventional perforation means, such as tubing or wireline-conveyed shaped-charge perforating guns, sliding sleeves, and/or TAP valves, among other possible examples.

For implementations utilizing jetting for perforation, the wellsite 100 may comprise a cutting fluid source 170 at the surface 115, such as may be utilized for cutting formation strata, control valves, and/or other subterranean and/or downhole features. The cutting fluid source 170 may, for example, supply an abrasive slurry and/or other cutting fluid to a passageway of the conveyance string 110, such that the cutting fluid may be radially directed by a jetting sub 154 to penetrate the casing string 130 and/or a surrounding formation. The jetting sub 154 may be part of or otherwise carried by the BHA 150.

The wellsite 100 may further comprise a treatment fluid source 175 at the surface 115 that may be utilized to introduce treatment fluid into the wellbore 110. The treatment fluid source 175 may comprise a treatment fluid reservoir, a pump, control valves, and/or other components, and may be in selective communication with an annulus defined between the conveyance string 140 and the sidewalls of the wellbore 110 and/or the casing string 130.

The wellsite 100 may further comprise a surface treatment monitoring system 180 at the surface 115, which may be in communication with a downhole treatment monitoring system 156 and/or other means for monitoring one or more parameters of the wellbore 110, such as in connection with the communication of one or more fluids downhole. The downhole treatment monitoring system 156 may be part of or carried by the BHA 150. The surface treatment monitoring system 180 and/or the downhole treatment monitoring system 156 may be individually or collectively utilized to, for example, regulate the delivery of fluids downhole based on one or more monitored parameters. For example, the surface treatment monitoring system 180 and/or the downhole treatment monitoring system 156 may be individually or collectively utilized to monitor a pressure within the wellbore 110, including in the multi-well implementations described below.

Figure 2:
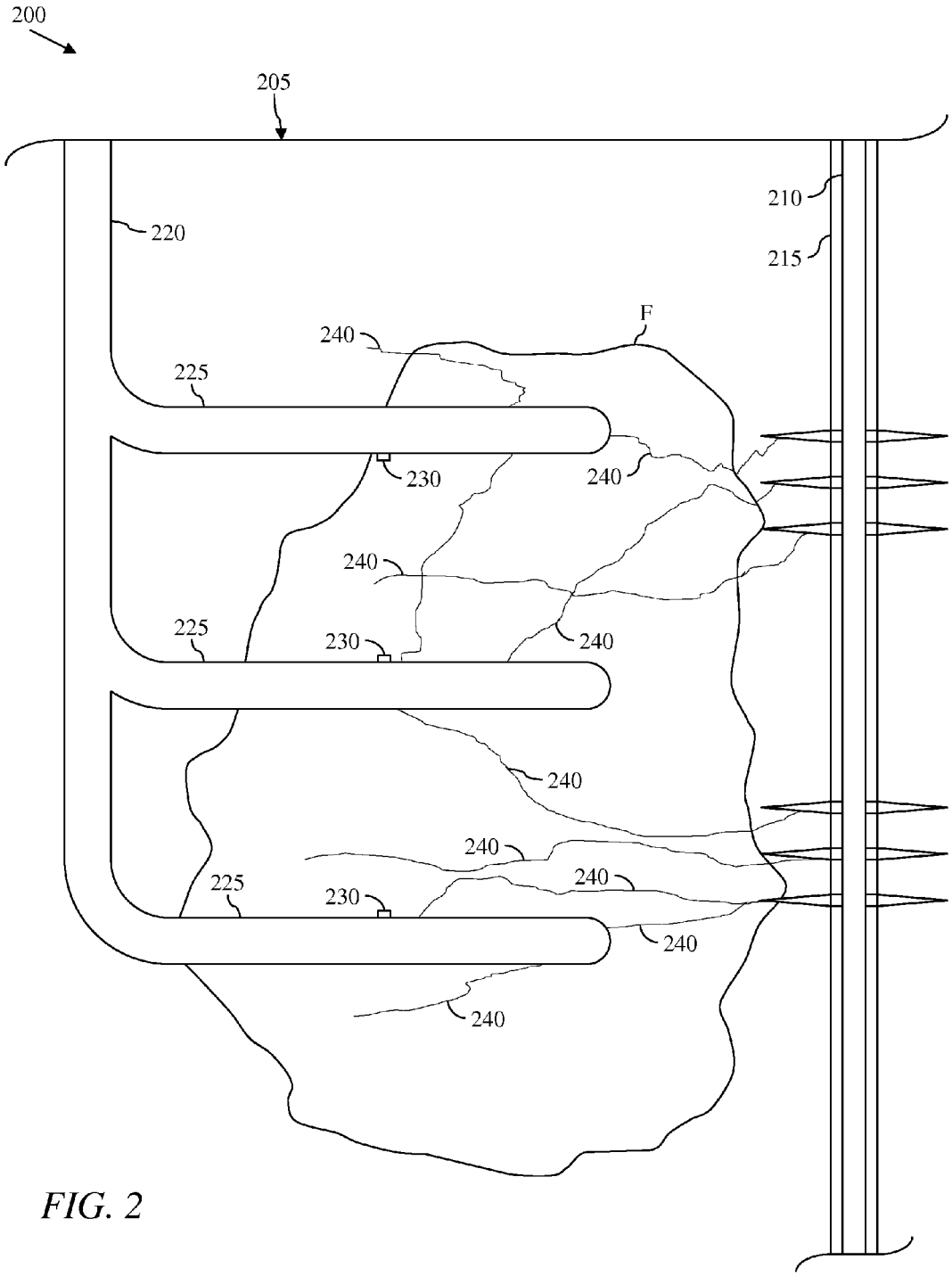
FIG. 2 is a schematic view of at least a portion of apparatus according to one or more aspects of the present disclosure.

While the implementation depicted in FIG. 1 comprises a single wellbore 110, aspects of the present disclosure may relate to implementations in or comprising two or more wellbores, one or more of which may comprise a multi-lateral well. FIG. 2 is a schematic view of one such implementation 200, which comprises a first wellbore 210 and a second wellbore 220. One or both of the first and second wellbores 210 and 220 may be substantially similar to or otherwise share one or more common aspects with the wellbore 110 shown in FIG. 1.

While either or both of the wellbores 210 and 220 may be or comprise a multi-lateral well, only the second wellbore 220 is depicted as such in FIG. 2, although merely for ease of understanding, as a person having ordinary skill in the art will readily recognize that aspects of the present disclosure may be applicable to implementations in which either, neither, or both of the wellbores 210 and 220 are multi-lateral, vertical, horizontal, and/or deviated wells. In implementations in which the first and/or second wellbore 220 is or comprises a multi-lateral well, such wellbore(s) may comprise multiple lateral sections 225. Cross-hatching is also excluded from FIG. 2 for the purposes of clarity and simplicity, although a person having ordinary skill in the art will readily recognize the schematic view of FIG. 2 as being a subterranean cross-sectional view of the first and second wellbores 210 and 220.

Additionally, the first wellbore 210 is depicted in FIG. 2 as being cased (and thus comprising a casing string 215), whereas the second wellbore 220 is depicted as being uncased. However, aspects of the present disclosure are applicable or readily adaptable to implementations in which either, neither, or both of the first and second wellbores 210 and 220 are cased. One or both of the first and second wellbores 210 and 220 may also comprise conventional completion equipment (not shown), such as plugs, perforations, sliding sleeves, and/or packers, among other completion apparatus within the scope of the present disclosure.

The first wellbore 210 may be hydraulically fractured using, for example, one or more fracturing techniques described above. The first wellbore 210 may additionally or alternatively be hydraulically fractured utilizing other techniques, such as those disclosed in U.S. Pat. No. 6,776,235 and/or U.S. Pat. No. 7,581,590, which are both hereby incorporated by reference in their entireties for all intents and purposes. As a result of the hydraulic fracturing, fractures 240 may initiate from the first wellbore 210 and propagate toward the second wellbore 220, such that the first and second wellbores 210 and 220 may ultimately be hydraulically coupled and, thus, interacting.

The second wellbore 220 may comprise one or more pressure sensors 230, such as is depicted in FIG. 2 in each of the lateral sections 225. The pressure sensors 230 are depicted as being imbedded into the sidewalls of the lateral sections 225 of the second wellbore. However, in other implementations within the scope of the present disclosure, the pressure sensors 230 may be otherwise positioned within the wellbore 220, whether temporarily or permanently. For example, a downhole tool comprising pressure sensors may be operable to be conveyed within the second wellbore 220 and measure pressure of the second wellbore 220 and/or the formation F via one or more probes extendable from or otherwise coupled to the downhole tool. An example of such a downhole tool is described below with respect to FIG. 6, although others are also within the scope of the present disclosure. The pressure sensors 230 may also or alternatively be part of or otherwise carried by a downhole treatment monitoring system and/or other feature of a BHA, such as of the BHA 150 shown in FIG. 1.

As cutting and/or other fracturing fluid (hereafter collectively referred to simply as fracturing fluid) is pumped into the first wellbore 210 from equipment at the surface 205 (such as the surface equipment shown in FIG. 1), a pressure pulse and/or other pressure change may be observed in the second wellbore 220, as detected by the pressure sensors 230. Such detection may indicate that one or more fractures 240 originating from the first wellbore 210 have expanded in length until they ultimately arrived at the second wellbore 220. For example, the detection may comprise comparing the pressure sensed in the second wellbore 220, or the change thereof, to a predetermined level. Once the detected pressure or pressure change exceeds the predetermined level, the first and second wellbores 210 and 220 may be considered to be in hydraulic communication and interacting.

Thereafter, the fracturing fluid being pumped into the first wellbore 210 may be circulated to the surface 205 via the second wellbore 220 (which may also be known as "return"). This return confirms that the first and second wellbores 210 and 220 are indeed in hydraulic communication and interacting.

Thereafter, the rate at which fracturing fluid is pumped into the first wellbore 210 may be gradually increased to, for example, compensate for the return from the second wellbore 220. Proppant may also be pumped into the first wellbore 210 to, for example, support the now interacting fracture system and returns taken from the one or more formations F intersected by the lateral sections 225 and/or other portions of the second wellbore 220.

The interaction of the fractures 240 with the second wellbore 220 may also cause a drop in the applicable pressure of the first wellbore 210. In such instances, the pressure at which fracturing fluid is pumped into the first wellbore 210 may be increased to compensate for this pressure change.

Similar implementations within the scope of the present disclosure may utilize the interacting hydraulic fracturing described above to connect any number of vertical, horizontal, deviated, and/or multi-lateral wells, whether the interacting fractures of such connection extend laterally, vertically, and/or otherwise. Moreover, when multiple formations F are potential targets and separate lateral wells or well sections have been utilized to complete the wells, one or more scaffolding or laddering techniques may be utilized according to one or more aspects of the present disclosure. One or more aspects of such scaffolding techniques may ensure and/or improve connectivity and interaction between the first and second wellbores 210 and 220, which may aid in increasing recovery.

Figure 3:
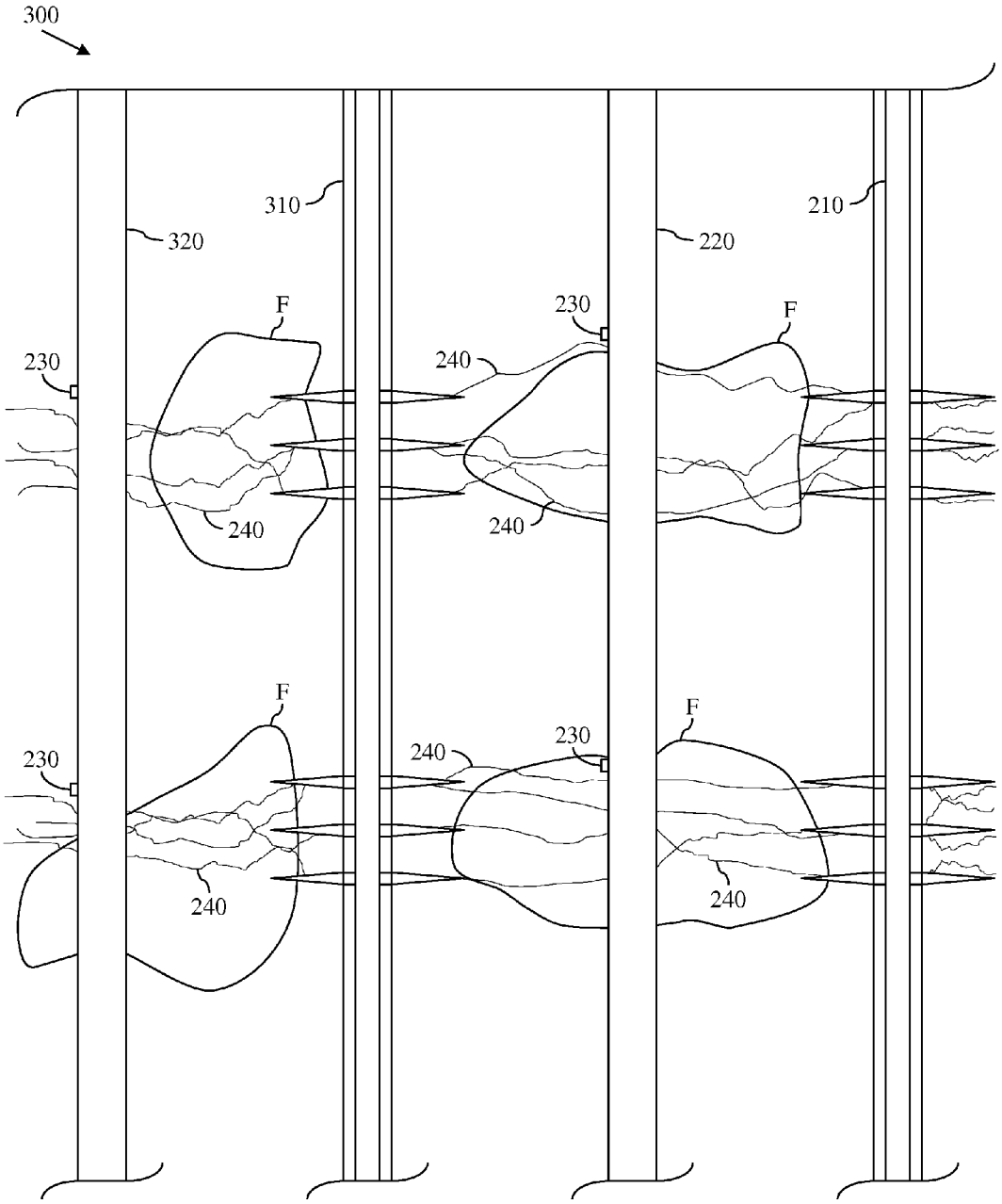
FIG. 3 is a schematic view of at least a portion of apparatus according to one or more aspects of the present disclosure.

FIG. 3 is a schematic view of one such implementation 300, which comprises the first and second wellbores 210 and 220 shown in FIG. 2, wherein the first wellbore 210 is utilized as a fracturing well and the second wellbore 220 is utilized as a target well. The implementation 300 shown in FIG. 3 also comprises an additional fracturing well 310 and an additional target well 320, which may be substantially similar or identical to the fracturing well 210 and the target well 220, respectively.

The two target wells 220 and 320 are hydraulically linked to the two fracturing wells 210 and 310 by fractures 240 according to aspects of the present disclosure. The target wells 220 and 320 may be positioned to intersect or engage multiple formations F, of which four are depicted in FIG. 3. As described above, when pressure sensors 230 provided in the target wells 220 and 320 indicate a change in pressure, proppant may be pumped into one or both fracturing wells 210 and 310, and returns may then be taken from one or both target wells 220 and 320.

Figure 4:
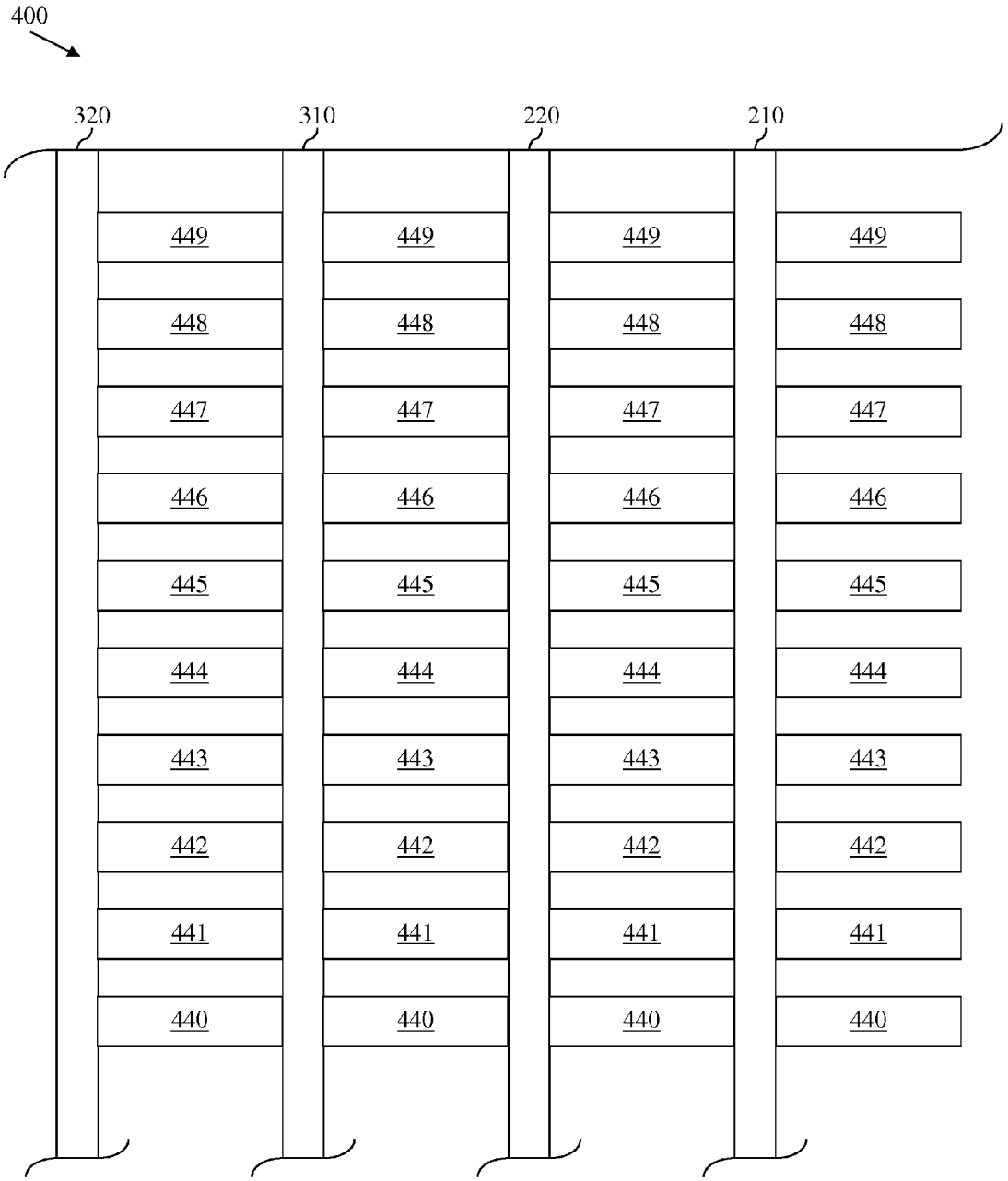
FIG. 4 is a schematic view of at least a portion of apparatus according to one or more aspects of the present disclosure.

FIG. 4 schematically depicts another example implementation 400. The implementation 400 depicted in FIG. 4 is substantially similar or identical to the implementation 300 shown in FIG. 3. However, in the implementation 400 shown in FIG. 4, the two target wells 220 and 320 and the two fracturing wells 210 and 310 are in hydraulic communication due to ten different fracturing stages 440-449. Each stage of fracturing 440-449 may be substantially similar to and/or comprise one or more fractures hydraulically coupling neighboring ones of the wells 210, 220, 310, and 320. As with the implementation 300 depicted in FIG. 3, the implementation 400 shown in FIG. 4 may be referred to as scaffolding or laddering.

Figure 5:
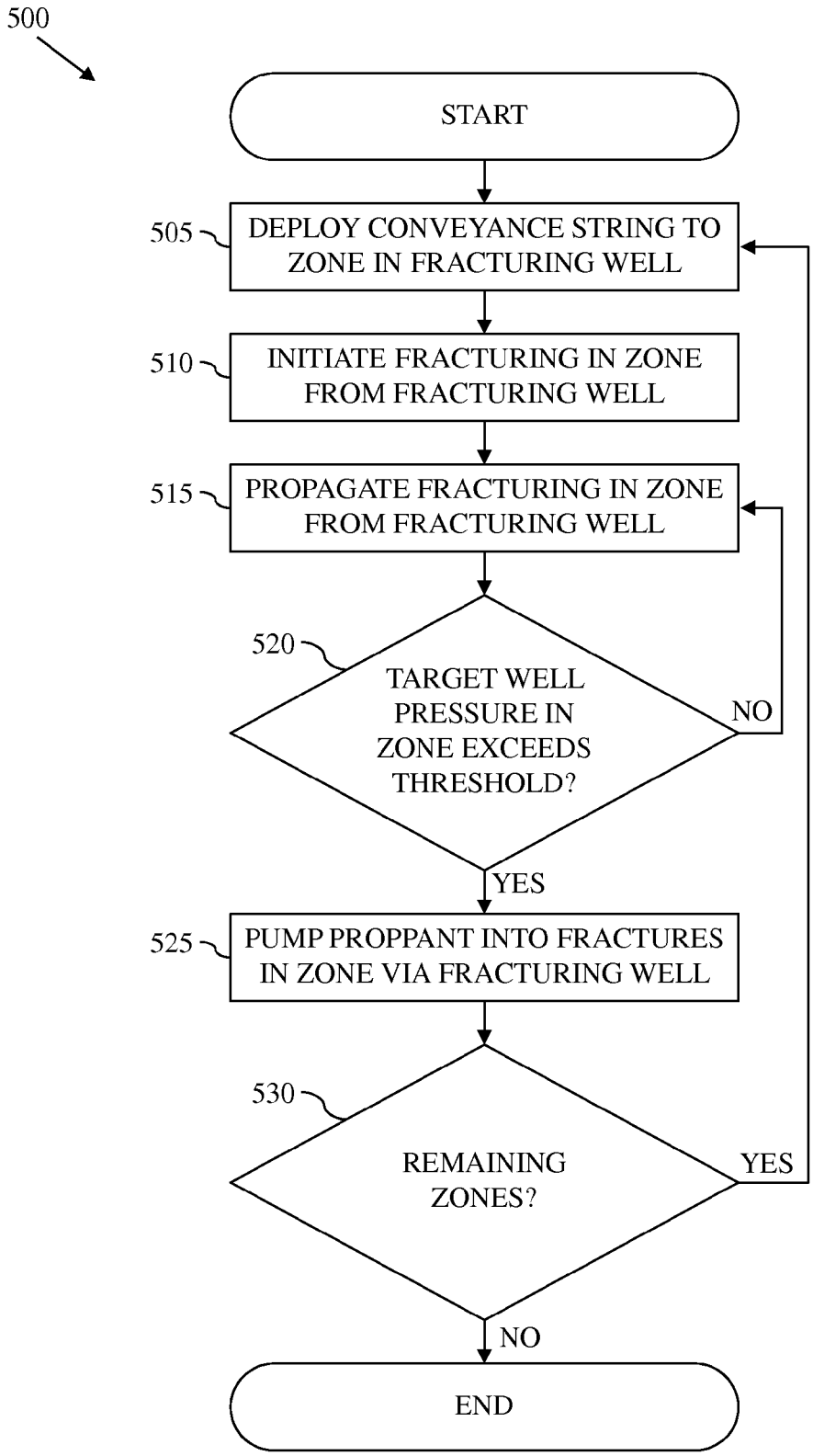
FIG. 5 is a flow-chart diagram of at least a portion of a method according to one or more aspects of the present disclosure.

FIG. 5 is a flow-chart diagram of at least a portion of a method 500 of interacting hydraulic fracturing according to one or more aspects of the present disclosure. The method 500 is described below with reference to FIG. 4. However, the method 500 and/or variants within the scope of the present disclosure may be performed to achieve the implementations shown in any of FIGS. 1-4, as well as other implementations within the scope of the present disclosure.

Thus, referring to FIGS. 4 and 5, collectively, the method 500 comprises a repeated loop for each fracturing stage 440-449. Each iteration of the loop comprises deploying (505) a conveyance string to the current zone of interest in one or more fracturing wells 210/310, initiating fracturing (510) from one or more fracturing wells 210/310 in the current zone, propagating (515) the resulting one or more fractures, and continuing to pump fracturing fluid into the one or more fracturing wells 210/310 until a pressure or pressure change in one or more target wells 220/320 exceeds a predetermined threshold (520). Proppant may then be pumped (525) from the one or more fracturing wells 210/310 to the one or more target wells 220/320 via the one or more fractures created during that iteration of the loop. Thus, the different fracturing stages 440-449 may each be established one at a time. If a determination is made (530) that other zones or fracturing stages have yet to be established, then the loop is repeated.

Variations of the method 500 within the scope of the present disclosure also include those in which multiple or all of the fracturing stages 440-449 are established substantially simultaneously, as well as those in which one or more portions of the loop are performed substantially simultaneously or serially for each fracturing stage 440-449 before other portions of the loop are performed. For example, the fracture initiation (510) may be performed for each zone or fracturing stage 440-449 in a single trip, such as by utilizing a perforating gun deployed on wireline. The fracture initiation (510) may entail the use of pre-perforated casing, shifting a sleeve to expose openings between the wellbore and the casing, cutting a slot or slots in the casing, laser perforating, chemical dissolution, and/or any other method for providing an opening in the casing string and initiating the fracturing.

Figure 6:
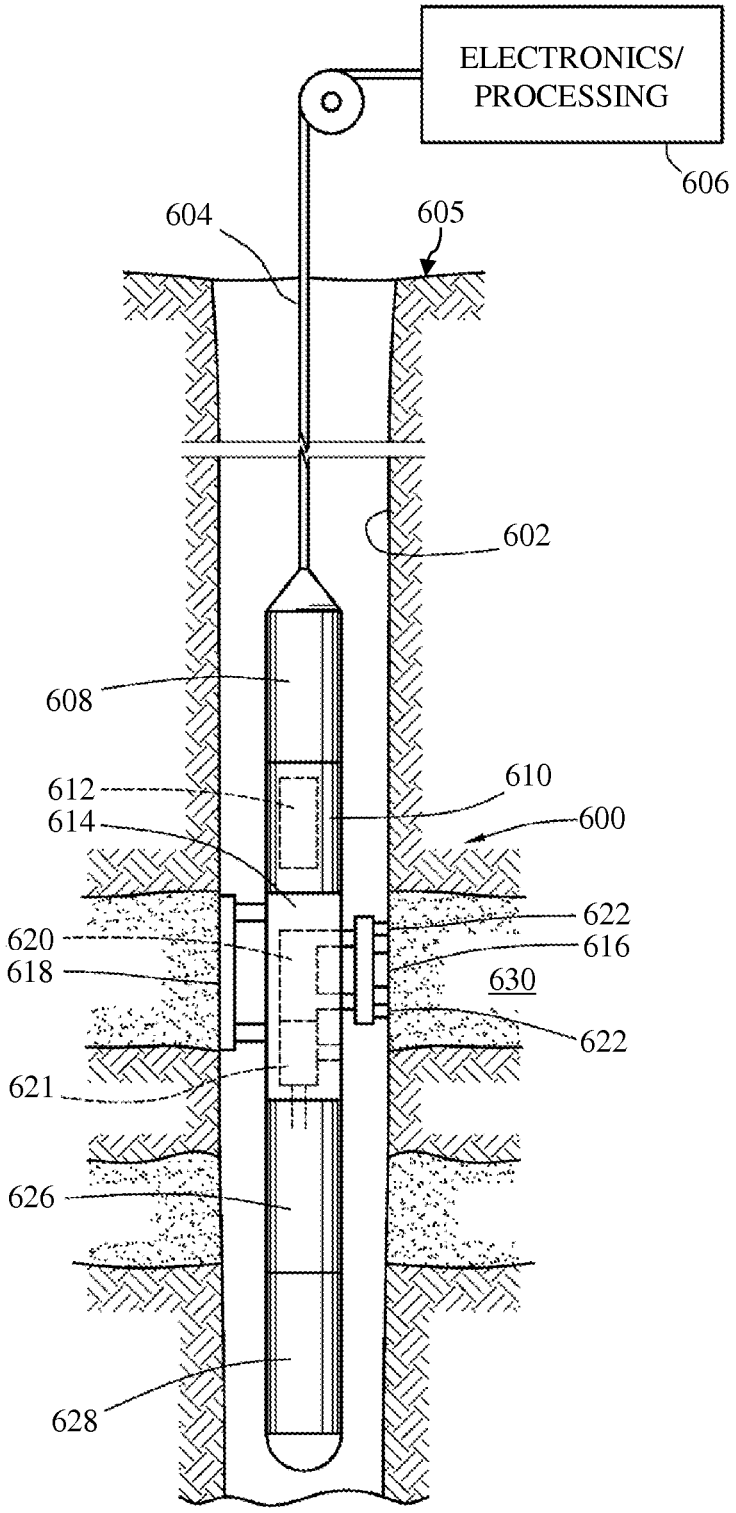
FIG. 6 is a schematic view of at least a portion of apparatus according to one or more aspects of the present disclosure.

FIG. 6 is a schematic view of an example wellsite system according to one or more aspects of the present disclosure. The wellsite may have one or more aspects in common with the wellsite 100 shown in FIG. 1 and/or the implementation shown in one or more of FIGS. 2-4, and comprises a wireline tool 600 configured for conveyance within a wellbore 602 penetrating a subterranean formation 630.

The wireline tool 600 may be suspended in the wellbore 602 from a lower end of a wireline and/or other multi-conductor cable 604 that may be spooled on a winch (not shown) at the surface 605. At the surface 605, the cable 604 may be communicatively coupled to an electronics and processing system 606. The electronics and processing system 606 may include a controller having an interface configured to receive commands from a surface operator. In some cases, the electronics and processing system 606 may further comprise a processor configured to implement one or more aspects of the methods described herein.

The wireline tool 600 may comprise a telemetry module 610 and a test module 614. Although the telemetry module 610 is shown as being implemented separate from the test module 614, the telemetry module 610 may be implemented in the test module 614. The wireline tool 600 may also comprise additional components at various locations, such as one or more modules 608 above the telemetry module 610 and/or one or more modules 626/628 below the test module 614, which may have varying functionality within the scope of the present disclosure.

The test module 614 may comprise a static or selectively extendable probe assembly 616 and a selectively extendable anchoring member 618 that are respectively arranged on opposing sides of the wireline tool 600. The probe assembly 616 may comprise one or more pressure sensors 622 operable to detect pressure and/or pressure changes within the wellbore 602. The one or more pressure sensors 622 may be located adjacent a port of the probe assembly 616, among other possible locations within the downhole tool 600. For example, the test module 614 may comprise a sensing unit 620 which may also comprise one or more pressure sensors and/or other types of sensors.

The probe assembly 616 may also be configured to selectively seal off or isolate one or more selected portions of the sidewall of the wellbore 602. For example, the probe assembly 616 may comprise a sealing pad that may be urged against the sidewall of the wellbore 602 in a sealing manner to prevent movement of fluid into or out of the formation 630 other than through the probe assembly 616. The probe assembly 616 may be configured to fluidly couple a pump 621 and/or other components of the test module 614 to the adjacent formation 630. Accordingly, the test module 614 may also be utilized to obtain pressure and/or fluid samples from the formation 630.

The sensors 622 and/or other sensors of the downhole tool 600 may also or alternatively be configured to determine other parameters of the wellbore 602, the formation 630, and/or fluids therein. For example, the sensors of the downhole tool 600 may be configured to measure or detect one or more of electric resistivity, dielectric constant, magnetic resonance relaxation time, nuclear radiation, and/or combinations thereof, although other types of sensors are also within the scope of the present disclosure.

The telemetry module 610 may comprise a downhole control system 612 communicatively coupled to the electronics and processing system 606. The electronics and processing system 606 and/or the downhole control system 612 may be configured to control the probe assembly 616 and/or the detection of pressure and/or pressure changes within the formation 630. The electronics and processing system 606 and/or the downhole control system 612 may be further configured to analyze and/or process data obtained from various sensors, store measurements or processed data, and/or communicate measurements or processed data to surface or another component for subsequent analysis.

In view of all of the above and FIGS. 1-6, a person having ordinary skill in the art should readily recognize that the present disclosure introduces a method comprising: initiating a fracture extending away from a first subterranean well and toward a second subterranean well by pumping fluid into the first subterranean well; propagating the fracture further towards the second subterranean well by continuing to pump fluid into the first subterranean well, while monitoring a pressure in the second subterranean well; and pumping proppant into the second subterranean well via the first subterranean well and the fracture upon detection of a change in the monitored pressure in the second subterranean well.

Monitoring the pressure in the second subterranean well may comprise operating a downhole tool positioned within the second subterranean well, wherein the downhole tool may comprise a pressure sensor.

The detection of the change in the monitored pressure in the second subterranean well may comprise the detection of an increase in the monitored pressure.

The detection of the change in the monitored pressure in the second subterranean well may comprise the detection of a decrease in the monitored pressure. The method may further comprise increasing a pressure at which the fluid is pumped into the first subterranean well to compensate for the decrease in the monitored pressure.

The method may further comprise collecting the fluid from the second subterranean well. Such method may further comprise increasing a pressure at which the fluid is pumped into the first subterranean well to compensate for the fluid collected from the second subterranean well.

At least one of the first and second subterranean wells may comprise at least one lateral section.

One of the first and second subterranean wells may comprise a plurality of subterranean wells.

The first subterranean well may comprise two first subterranean wells, and the second subterranean well may comprise two first subterranean wells.

The present disclosure also introduces a system comprising: a first subterranean well; and a second subterranean well having a pressure sensor responsive to fluid pumped into the first subterranean well.

The first subterranean well may be a cased well.

The system may further comprise a downhole tool positioned in the second subterranean well. The downhole tool may comprise the pressure sensor.

The pressure sensor may be permanently installed in the second subterranean well.

At least one of the first and second subterranean wells may comprise at least one lateral section.

The present disclosure also introduces a system comprising: a first plurality of subterranean wells; and a second plurality of subterranean wells each having a pressure sensor responsive to fluid pumped into at least one of the first plurality of subterranean wells.

At least one of the first plurality of subterranean wells may be a cased well.

The system may further comprise a plurality of downhole tools each positioned in a corresponding one of the plurality of second subterranean wells. Each of the plurality of downhole tools may comprise the pressure sensor within the corresponding one of the plurality of second subterranean wells.

The pressure sensor of at least one of the second plurality of subterranean wells may be permanently installed therein.

At least one of the first and second pluralities of subterranean wells may comprise at least one lateral section.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

initiating a fracture extending away from a first subterranean well and toward a second subterranean well by pumping fluid into the first subterranean well;

propagating the fracture further towards the second subterranean well by continuing to pump fluid into the first subterranean well, while monitoring a pressure in the second subterranean well; and pumping proppant into the second subterranean well via the first subterranean well and the fracture upon detection of a change in the monitored pressure in the second subterranean well.

2. The method of claim 1 wherein monitoring the pressure in the second subterranean well comprises operating a downhole tool positioned within the second subterranean well, and wherein the downhole tool comprises a pressure sensor.

3. The method of claim 1 wherein the detection of the change in the monitored pressure in the second subterranean well comprises the detection of an increase in the monitored pressure.

4. The method of claim 1 wherein the detection of the change in the monitored pressure in the second subterranean well comprises the detection of a decrease in the monitored pressure.

5. The method of claim 4 further comprising increasing a pressure at which the fluid is pumped into the first subterranean well to compensate for the decrease in the monitored pressure.

6. The method of claim 1 further comprising collecting the fluid from the second subterranean well.

7. The method of claim 1 further comprising:

collecting the fluid from the second subterranean well; and increasing a pressure at which the fluid is pumped into the first subterranean well to compensate for the fluid collected from the second subterranean well.

8. The method of claim 1 wherein at least one of the first and second subterranean wells comprises at least one lateral section.

9. The method of claim 1 wherein one of the first and second subterranean wells comprises a plurality of subterranean wells.

10. The method of claim 1 wherein the first subterranean well comprises two first subterranean wells, and wherein the second subterranean well comprises two first subterranean wells.

* * * * *